US005343202A

United States Patent [19]

Bell

[11] Patent Number: 5,343,202

[45] Date of Patent: Aug. 30, 1994

[54] RADAR REFLECTOR

[75] Inventor: Stephen W. Bell, Woodbridge, Great Britain

[73] Assignee: GEC Marconi Limited, Stanmore, United Kingdom

[21] Appl. No.: 969,858

[22] PCT Filed: May 3, 1991

[86] PCT No.: PCT/GB91/00712

§ 371 Date: Jan. 8, 1993

§ 102(e) Date: Jan. 8, 1993

[87] PCT Pub. No.: WO91/17587

PCT Pub. Date: Nov. 14, 1991

[30] Foreign Application Priority Data

May 8, 1990 [GB] United Kingdom ..... 9010279

[51] Int. Cl.[5] ..... H01Q 15/00

[52] U.S. Cl. ..... 342/5; 342/10

[58] Field of Search ..... 342/8, 5, 10

[56] References Cited

U.S. PATENT DOCUMENTS

| | | | |
|---|---|---|---|
| 2,721,998 | 10/1955 | Holm | 342/8 |
| 4,028,701 | 6/1977 | Parks et al. | 342/8 |
| 4,195,298 | 3/1980 | Firth | 342/8 |

FOREIGN PATENT DOCUMENTS

| | | |
|---|---|---|
| WO91/17587 | 11/1491 | PCT Int'l Appl. . |
| 2216725 | 10/1989 | United Kingdom . |
| 2234119 | 1/1991 | United Kingdom . |

*Primary Examiner*—Mark Hellner

*Attorney, Agent, or Firm*—Spencer, Frank & Schneider

[57] ABSTRACT

Radar reflector structure is disclosed including a plurality of reflector elements which in use are arranged in a non-planar configuration, the reflector elements include a thin flexible member extending between adjacent reflector elements substantially at or below the surface of the elements, the thin flexible member thereby providing a flexible hinge between the elements.

16 Claims, 6 Drawing Sheets

RADAR REFLECTOR

BACKGROUND TO THE INVENTION

The present invention relates to a radar reflector structure of the type used, for example, to enhance the radar signature of an aircraft, ship or other vehicle.

The present applicant's earlier unpublished application number 8911792.3 and published application GB-A-2216725 disclose reflector structures formed from a number of trihedral re-entrant corner reflectors, each corner reflector comprising three planar elements lying at angles to each other. It has previously been proposed to form such structures either by folding from a single blank or by joining together a number of separate elements with hinges. The use of hinges has the advantage that the structure can be made to fold flat for storage prior to deployment. As described in GB-A-2216725 the structure may be made self-erecting by the use of springs fitted between the elements so as to pull them into the desired shape. Although mechanical hinges may be used these are costly to produce and because of their physical bulk place constraints on the location of the hinge axes. The assembling of the separate reflector elements and the fitting of the hinges also adds considerably to the time taken for manufacture.

SUMMARY OF THE INVENTION

According to the present invention, in a radar reflector structure including a plurality of reflector elements which in use are arranged in a non-planar configuration, the reflector elements include a thin flexible member extending between adjacent reflector elements substantially at or below the surface of the elements, the thin flexible member thereby providing a flexible hinge between the elements.

Preferably the reflector elements are formed as laminates including a rigid layer and the thin flexible member is provided by a layer of the laminates extending integrally across adjacent reflector elements.

By forming the reflector elements with a flexible member which extends between a number of different elements, the present invention provides an integral hinge between the elements. This hinge is considerably less expensive in terms of materials and manufacture by comparison with conventional mechanical hinges and has the further important advantage of a greatly reduced physical bulk. Such a hinge can then be freely formed where required without the constraints on positioning associated with bulky mechanical hinges and without detracting from the ability of the structure to be collapsed into a flat low-volume configuration for storage prior to deployment.

Preferably the thin flexible layer is a polymeric plastics film adhesively bonded to the surface of the reflector elements. More preferably, the thin film is a polyester or polyimide film.

Preferably the reflector elements are formed from printed circuit board (PCB) laminates including a metal layer on at least one surface.

The present inventor has found that the widely available PCB laminates are particularly suitable for forming the reflector elements of the present invention. PCB is available in a wide variety of compositions. Epoxide, polyester, polyimide, and polyether-ether ketone resins are used with many fibre fillers, typically glass which may be in the form of glass cloth, to provide the rigid core. The glass cloth is usually woven, but fibres may be aligned in a single direction, in which case preferably the direction of alignment is substantially normal to the line of the hinge.

Typically one or preferably two surfaces of the PCB laminate are coated with copper. Normally this copper would be etched away to form a circuit, but in the present invention the copper layer is left whole to provide the required reflective properties of the element. PCB laminates have the further advantages of being flat, rigid, tough and heat resistant.

For reflecting radar at substantially 10 GHz, preferably the reflector laminate includes a metal layer having a thickness in the range 0.01 to 1 mm. More preferably the thickness is substantially 0.2 mm.

The preferred thicknesses for the metal layer give highly efficient reflection of radar. Thicker layers may be used, but if the thickness is reduced below a lower limit in the region of 5 microns reflection becomes markedly less efficient.

The lower thickness limit is in the vicinity of the surface charge depth, which is defined by $$(\pi f \mu \sigma)^{-\frac{1}{2}}$$

where f is the frequency $\mu$ is the permeability of the surface layer $\sigma$ is the conductivity of the surface layer.

Preferably where the thin flexible layer is a polymeric plastics material the thickness is in the range 0.1 to 1.0 mm and more preferably in the range 0.2 to 0.5 mm.

Some PCB laminates include a cloth layer near each face and this layer may be used to form the hinge. By using a suitable scoring cutter or press tool, the resin of the PCB can be fractured leaving the fabric of the laminate intact, so that it remains to act as a hinge. The limited life in terms of the maximum number of flexures before fracture of this type of hinge is no drawback for decoy or safety applications where the reflector must deploy quickly and accurately and remain effective for only a limited period. The reflector structure may be used only once or alternatively can be repacked flat and set ready to be deployed on subsequent occasions.

Preferably the cloth laminate is Kevlar.

As an alternative to the use of PCB laminates a honeycomb cored metal faced laminate may be used. Such laminates are commonly manufactured in large accurately-flat sheets for use, for example, in aerospace applications. To produce the reflector elements of the present invention polyester or polyimide film can be bonded to the metallic surfaces to form the hinges. Preferably laminates of this latter type are used where a larger reflector structure (typically with dimensions greater than 2 m) is required. In this case the thickness of the plastics film is preferably 1.0 mm or greater.

Preferably each reflector element is formed as a dual laminate, comprising a pair of individual laminates each including its own rigid layer and bonded together on opposing surfaces. In this case, preferably the radar reflector structure includes separator plates formed in part of a single laminate of each dual laminate structure and arranged in use to move out of the plane of the dual laminate structure about a hinge formed by the thin flexible layer so as to extend between adjacent reflector elements.

The use of separator plates in fold-flat reflector structures is described in detail in the applications cited above. However, hitherto these separator plates have been fixed on top of the reflector elements so that they add significantly to the bulk of the structure and make it impossible to fold the reflector elements back onto each other. In these known structures, in the flat configuration the reflector elements lie side by side so that the structure as a whole is elongated. For storage or deployment the reflector then needs a container which is correspondingly long.

The present inventor has found that by using a dual laminate structure and forming the separator plate as part of one of the lamina elements of that dual laminate structure a separator plate can be provided which, when not in use, lies in the same plane as the reflector element. When in use, the separator plate is moved out of the plane of the element about a hinge formed from the thin flexible layer, as discussed above. With this arrangement, the hinge formed by the flexible layer lies above the surface of the separator plate making it possible to fold the reflective elements joined by the hinge back onto each other. The present invention therefore makes possible a reflector structure which can be collapsed concertina-wise. According to a further aspect of the present invention, in a radar reflector structure including a plurality of reflector elements which in use are arranged in a non-planar configuration, the reflector elements are arranged to fold back on each other concertina-wise thereby collapsing the structure when not in use.

The reduced bulk when folded flat of a reflector structure formed in accordance with this aspect of the present invention is found to be particularly valuable when producing reflectors for packaging in cartridges of limited volume and especially in the production of a high performance reflector for use in life rafts. Inflatable life rafts are normally packaged in canisters of a standard, very limited, shape and size. The present invention makes it possible to package within that canister a high performance radar reflector.

The reflector structure is also suitable for use as a missile decoy or for other military uses where it necessary to deploy automatically a reflector with a predetermined reflective configuration. The reflector may be collapsed for storage prior to deployment and delivery to the site where it is required. The collapsed structure may be launched, for example, within the body of a missile which releases the reflector at the deployment site where, using the self-erecting mechanism discussed above, it automatically adopts the non-planar reflective configuration. The greatly reduced volume of the reflector when collapsed reduces the demands made on the deployment system so that, for example, smaller missiles may be used to deliver the reflector to the deployment site.

BRIEF DESCRIPTION OF DRAWINGS

A radar reflector in accordance with the present invention will now be described in detail with reference to the accompanying drawings in which.

DETAILED DESCRIPTION OF EXAMPLES

Figure 1:
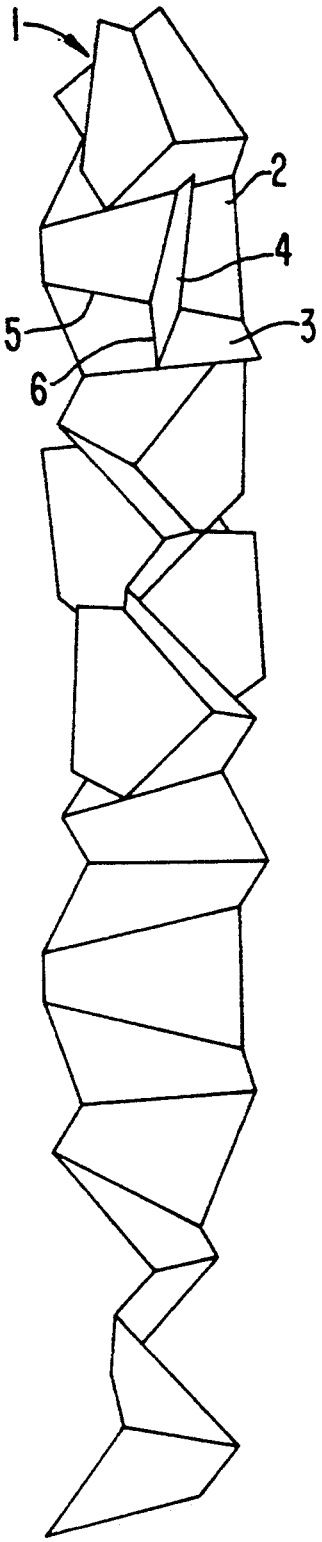
FIG. 1 is a first example of a radar reflector structure.

As shown in FIG. 1, a radar reflector structure 1 is formed from a number of reflector elements 2,3,4. The reflector elements 2,3,4 are arranged to provide a string of re-entrant trihedral corners. Adjacent elements 2,3 are joined together along a hinge 5 and form two sides of the trihedral corner. The third element of the trihedral corner is provided by a separator plate 4 joined to the element 2 along a hinge line 6 partway along that element.

Figure 2:
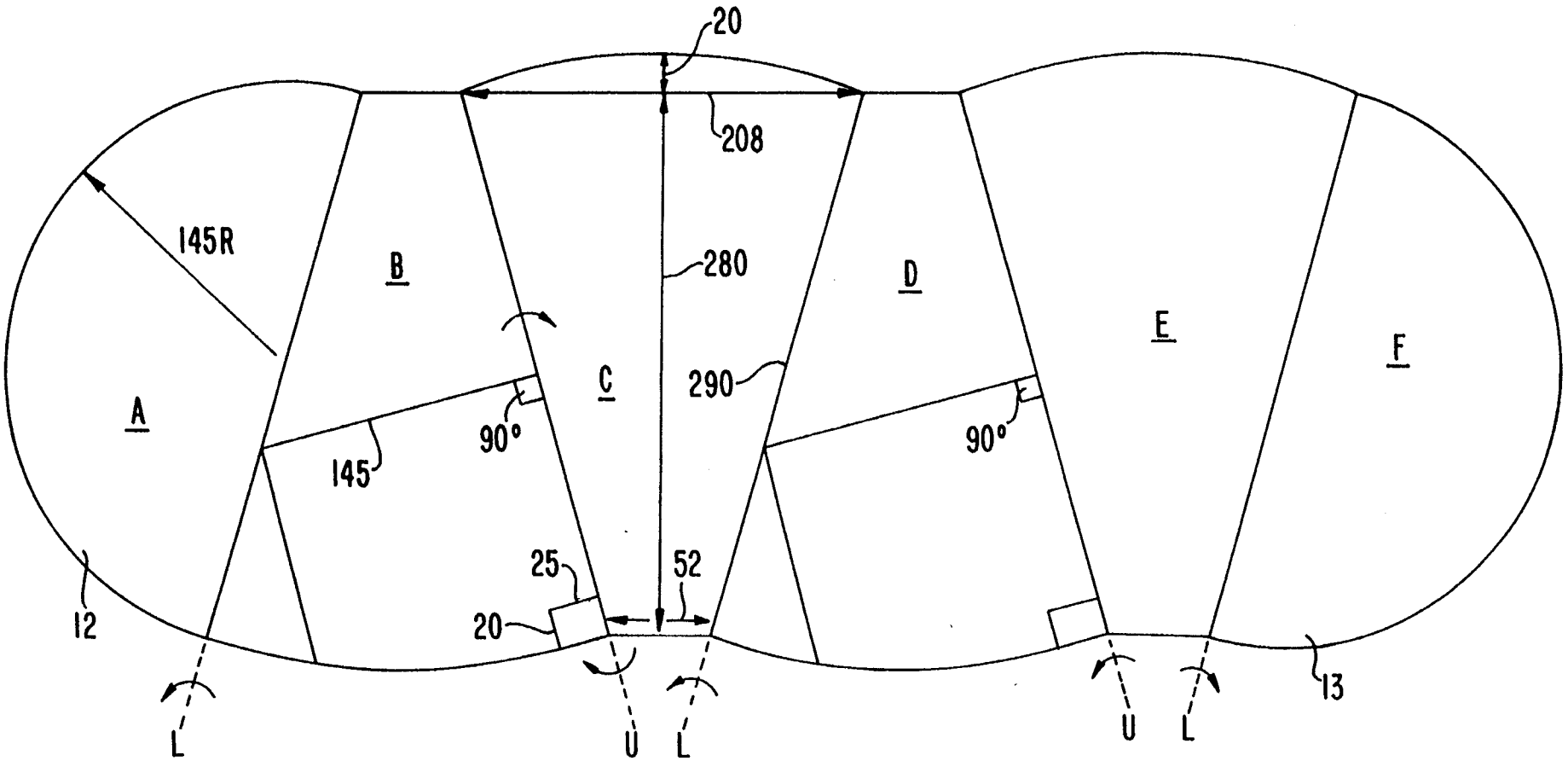
FIG. 2 is a plan of a fold-flat reflector structure particularly suitable for use with life rafts.
Figure 4:
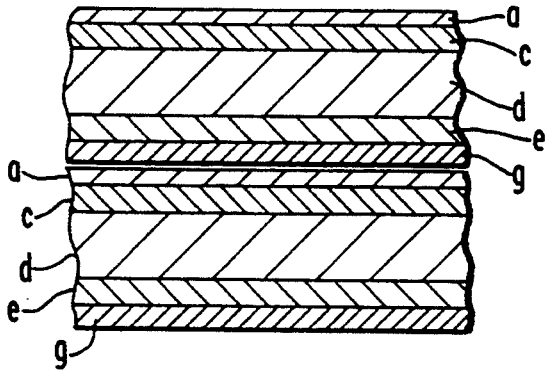
FIG. 4 is a section showing the laminate structure.

As shown in FIG. 2, individual reflector elements are generally trapezoidal in shape but with one end radiussed. Each element is formed from a pair of laminates, with the opposing inner surface of those laminates bonded together. The outer surfaces of the laminates are covered by a thin polyester or polyimide film. Polyimide is the more expensive material but is preferred for applications where its higher strength tear-resistance, and better high temperature properties are required.

Tables 1 and 2 describe the composition of two alternative laminate structures. The first structure described in Table 1 uses a PCB laminate having a polyester core coated with copper on both sides. After the PCB laminates have been cut to the desired trapezoidal shape and bonded together on their inner surfaces they are assembled into the required configuration shown in FIG. 2. A thin flexible layer, which in this first example is a polyester film of 0.125 mm thickness, is then bonded to the elements in a plate press so that the film layer extends across adjacent trapezoidal elements and provides a hinge where those elements meet. In the presently preferred embodiment the polyester film is applied to both the upper and lower surfaces of the dual laminate structure. Initially when the dual laminate structure leaves the press in which it is formed it has films extending continuously across both its uppermost and lowermost surfaces. Where a hinge is required on the upper surface between two elements then the film on the lower surface between the two elements is slit leaving the film on the upper surface intact. Conversely where the hinge is required on the lower surface then the film on the upper surface is slit. As shown in FIG. 2, along the length of the reflector structure the hinges are formed alternately on the upper and on the lower surfaces.

Table 2 lists the elements of a dual laminate structure using an aluminium honeycomb core of 10 mm thickness faced with an aluminium layer of 2.0 mm thickness. A plastics film is bonded to the laminate structure in the same manner as described above for the first example. In this example however the plastics film is polyimide of 0.5 mm thickness, in order to provide improved strength and tear-resistance.

Different laminate structures may be used in addition to those discussed above and in some circumstances it is possible to omit layers g and h of the laminate. Where a laminate is used which does not have an inherently radar reflective layer then an additional reflective sheet such as aluminium foil may be added to the laminate in the construction of the reflective element.

It is important that the adhesive chosen to bond the flexible film to the rigid core should have a high peel strength. Some standard polyester adhesives which have a relatively low cohesive strength may therefore not be suitable. Better results are achieved using acrylates and in particular cyanacrylates or super glue are particularly suitable. Acrylate adhesive are also suitable for use with polyimide films. A further improvement in this respect may be achieved by using a phenol formaldehyde adhesive.

Figure 7:
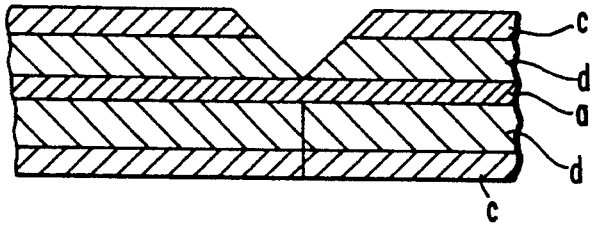
FIG. 7 is a scrap section of an alternative laminate structure in the region of a hinge.

As an alternative approach to avoiding peel or delamination, the laminate structure may be reversed so that the flexible layer is formed in the centre of the laminate rather than at its surfaces. A suitable laminate structure might then be copper/core/adhesive/film/adhesive/-core/copper. In this case, as shown in FIG. 7, the core is chamfered back to 45° on one or both sides to allow a 90° bend. This arrangement also allows through-fastenings such as rivets, screws or bolts to be used to combat further any tendency to delamination under the stresses of the environment in which the reflector structure is deployed. When using such a laminate structure, the reflector is arranged to fold flat into an elongated configuration, rather than collapsing concertina-wise.

Amongst other alternative laminates, cores may be used which are formed from foams Of PVC or phenolic-with microspheres. Foam can be covered with a skin of GRP (glass reinforced plastics) or Kevlar or carbon fibre. The use of a carbon fibre on a foam core is particularly advantageous since the carbon fibre is inherently radar reflective. Where a light relatively low-cost structure is required then cardboard stiffened with a suitable resin may be used to provide the core of the laminate. A suitable material for this purpose is, for example, the vulcanised fibre commonly used for the manufacture of luggage. As a further alternative, paper fibres mixed with styrene-butadene resin, which may be precipitated onto the fibres before they are formed to shape, provides another light and tough fibre-reinforced material. Such materials then only need the addition of a thin layer of aluminium or copper or any other electrical conductor to give them the required radar reflective properties.

In a further embodiment, the laminate has a four layer structure comprising:

1. Polyester
2. Metal
3. Core
4. Polythene

For a dual laminate the structure is then of the form 1, 2, 3, 4|4, 3, 2, 1. The laminate is formed using manufacturing techniques generally similar to those used for producing paper laminates for packaging. Layers 1, 2 and 3 are fed simultaneously from respective rolls to a laminating station providing a continuous lamination process. As an alternative to feeding polyester and metal substrates from different sources, a polyester film which has already been metallised may be used, so that in effect layers 1 and 2 are combined prior to the lamination process. The core layer may be formed from paper which may be flat, corrugated or bulked (i.e. having been treated to give increased thickness and reduced density). As an alternative core material polypropylene may be used. In most applications a thickness of polypropylene of 2 mm or more is required to give sufficient stiffness.

Figure 9A:
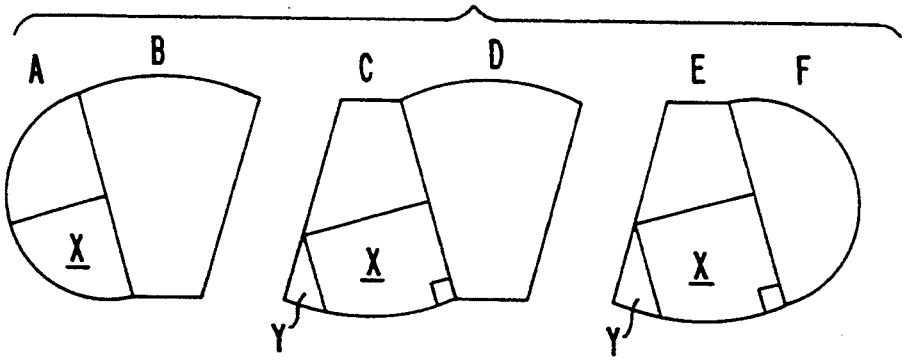
FIGS. 9A and 9B are plans showing blanks for the front and rear respectively of a dual laminate structure.
Figure 9B:
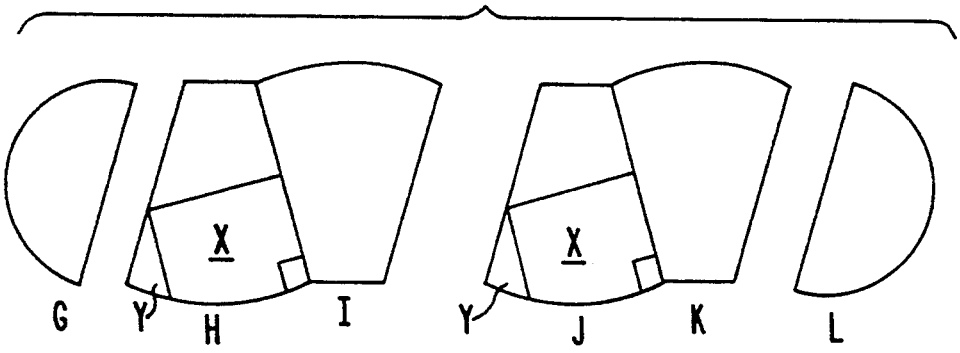

In a particularly preferred example suitable especially for smaller structures less than five or six meters high and typically of dimensions 2 ft (60 cm) high by 1 ft (30 cm) diameter, extruded twin-wall polypropylene having a ladder cross-section and a typical thickness of 3 mm±1 mm is used as the core material. Such a material is widely available under the trade names CORREX and TWINFLUTE. It is hinged by crushing or slitting along the line of the space between the ribs or alternatively by crushing or cutting at right angles to the ribs. Along the line of the hinge one only of the upper and lower surfaces is cut, leaving the other surface to provide the flexible hinge member. Alternatively, when the hinge is formed by crushing, the crushed hinge line runs at an angle to the flutes, to give optimum structural properties. In this manner, in either case, the material integrates the core and hinge layers of the laminate. To provide the required reflectivity aluminium foil 250 microns thick is bonded onto at least one of the surfaces of the polypropylene core. Alternatively the surface of the material may be printed with a metallic, e.g. silver, ink. This ink is then covered with a protective lacquer. As with the other structures discussed above a pair of such structures may be used back to back to provide a dual laminate reflector, in this case the outer surface of the core may be laminated with polythene on its other surface to facilitate bonding, but preferably is bonded directly back to back. For this embodiment pairs of adjacent reflectors are formed by cutting and scoring a single integral fluted polypropylene blank. Separate blanks are used for the front and back of the dual laminate structure. FIGS. 9A and 9B show the shape of blanks for the front and back respectively.

The repeat units CD/HI/JK are identical. There is a central hole HO in each face located where the bisectors of each edge meet. Regions X flap up and Y are offcut. Unit AB is identical to EF in external profile and in the hinge across it, but flap X is on part A of AB and part E of EF (where Y also is offcut). Units G, L are not reflective, and although included in the present embodiment to provide additional stiffening, may, in alternative embodiments, be omitted. The tab part of the spine hinge is secured mechanically at Z.

Figure 10:
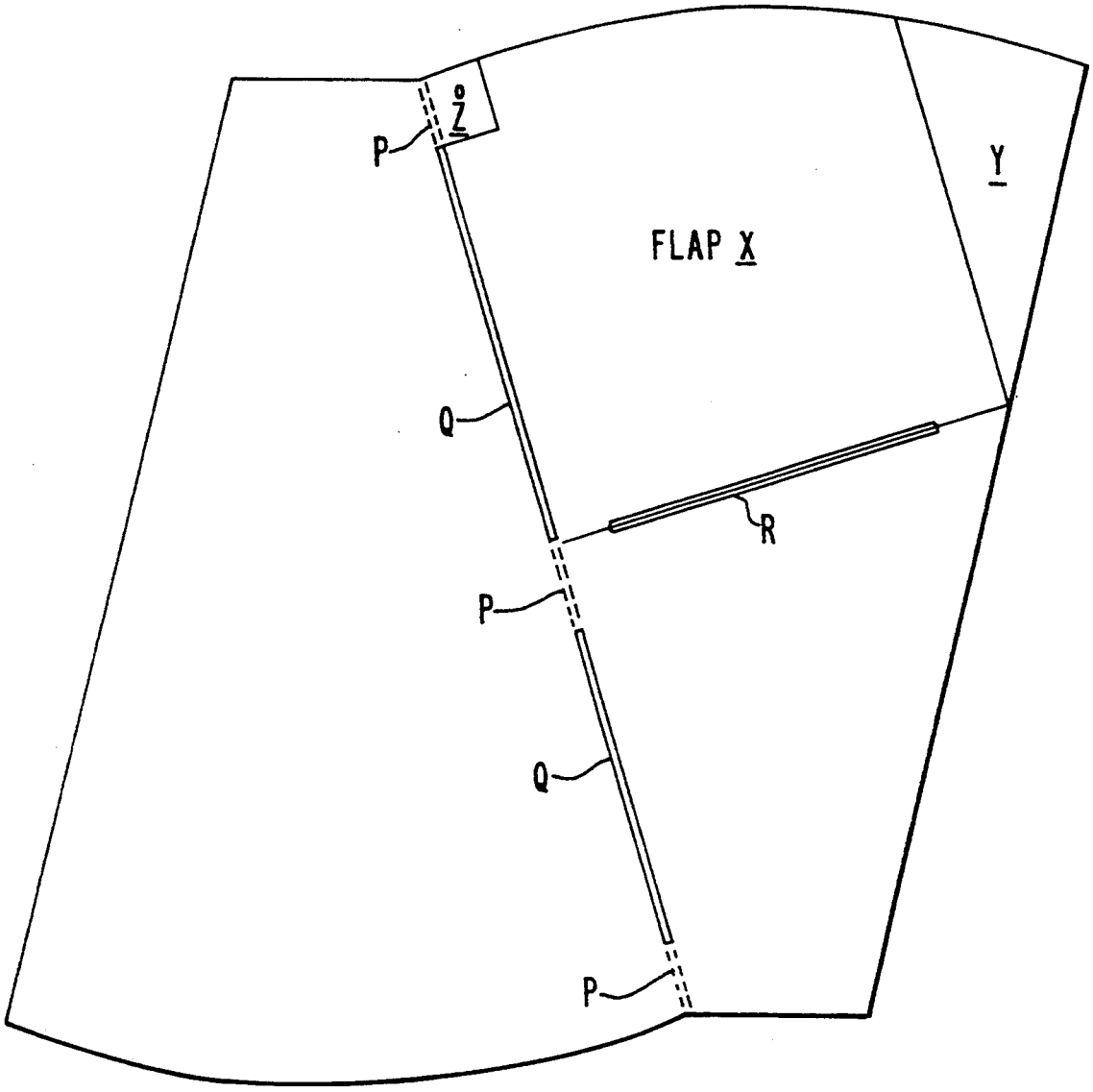
FIG. 10 is a plan of a single blank of the embodiment of FIG. 9.

As shown in FIG. 10, the hinge line P is formed between two score lines cut in the upper surface of the polypropylene. In the region Q, the score line is cut right through. In region R there is a central score line, and on either side of the score line the upper surface of the polypropylene is cut right through.

Figure 11:
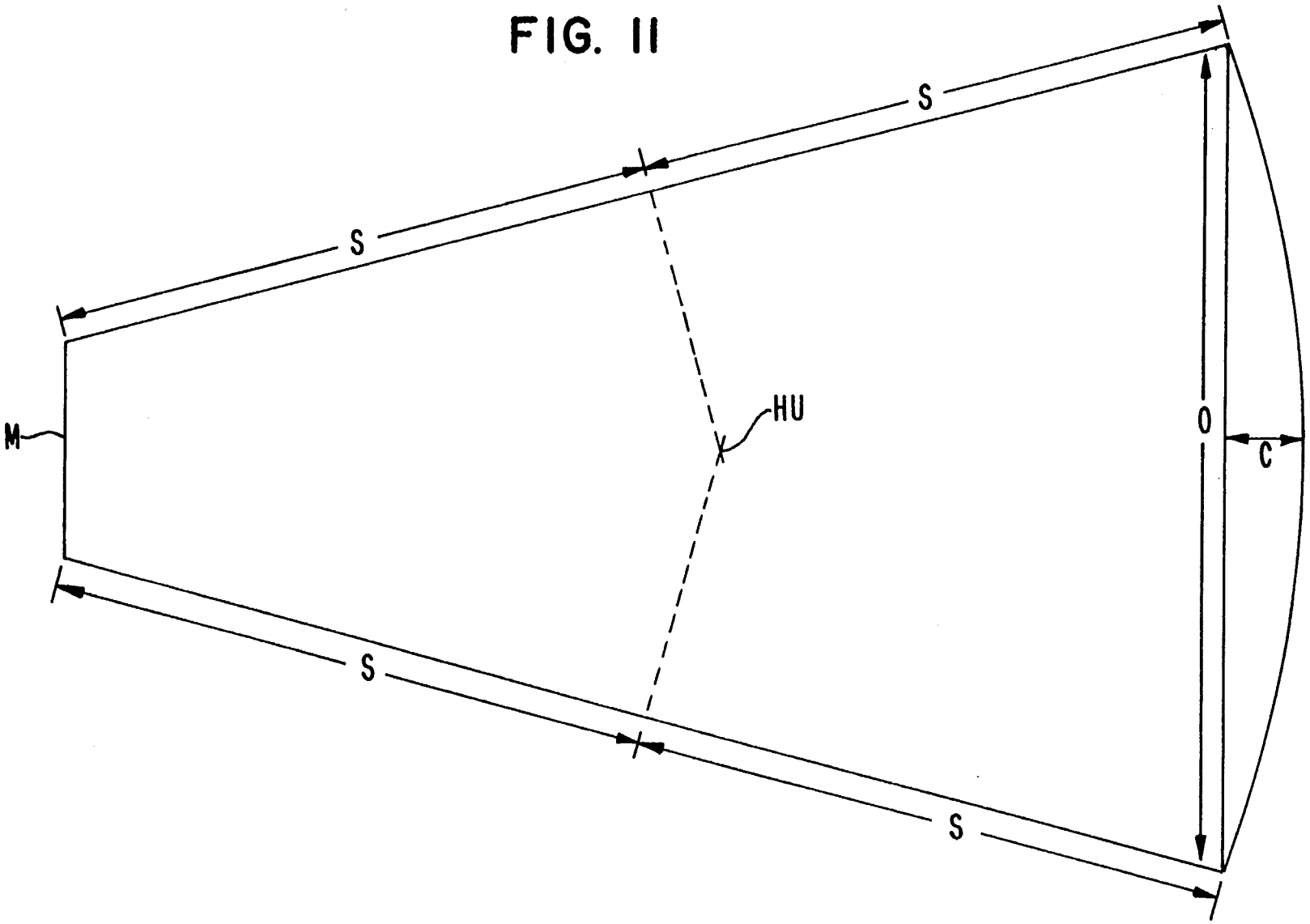
FIG. 11 is a diagram showing the dimension of a single trapezium reflector element.

FIG. 11 is a plan showing the dimension of a single trapezium unit. The dimensions in millimeters are as follows:

M 52 mm S 145 mm O 206 mm C 20 mm

The semicircular end pieces G, L have a radius of curvature of 145 min.

Figure 8A:
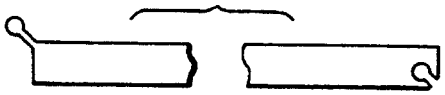
FIGS. 8A to 8D are side elevations of injection moulded elements for use in a further alternative embodiment.
Figure 8B:
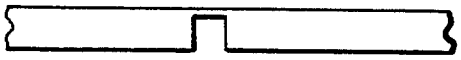
Figure 8C:
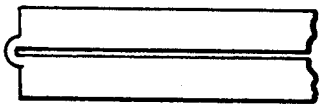
Figure 8D:
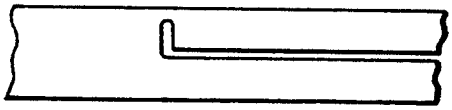

As an alternative to the use of an integral hinge layer which extends across the entire surface of the reflector elements a local hinge member may be used. This is the preferred structure when the reflector elements are formed by injection moulding in plastics. In this embodiment the plastics material is a polycarbonate of relatively low modulus so that bending at the hinge can occur without cracking. As shown in FIG. 8 the reflector elements are moulded with a male dumbell-shaped projection along one edge and a correspondingly shaped female socket along the other edge. Adjacent elements are joined together by insertion of the male projection in the female socket.

Where a dual-layer structure is required, the injection moulding may be done in pairs of planes with the separator plate moulded in place in one plane as shown in FIG. 8*d*. A series of such elements is then joined to form the body of a chain with a variant moulding to round off the ends. Alternate spine hinges are integral as are all of the separator plates. Also included in the injection moulding are projections which act as stops for the opening separator plates corresponding recesses may be formed in the adjacent portion of the moulded plate to allow the elements to pack perfectly flat. Attachment points for springs for use in the self-erecting mechanism are arranged in a similar manner.

A hybrid injection moulding may be used with dumbell extrusions inserted into the mould prior to injection so that they become bonded in place at some or all of the hinges.

In this embodiment, radar reflectivity may be arranged by including electrically conducting particles (e.g. Al, Cu, or carbon) within the plastic. Alternatively a metallised layer of, e.g., Al may be deposited by spray coating. As a further alternative thin metallic foil may be bonded to the elements. This last method makes it possible to leave some faces of the reflector free from the reflective material in order to tailor the response of the reflector to a required polarisation state, e.g. circular polarisation.

In a further embodiment which is particularly preferred for larger structures of 5 or 6 or more meters height each reflector element is formed from a metal faced honeycomb core. At the opposing edges of the reflector element, and at the boundary between an element and a separator plate, a flexible plastics moulding is fitted, which receives both the edges and which between them provides a flexible member of the same shape as that used in the injection moulded elements discussed above.

For an inexpensive lightweight laminate suitable for structures requiring only a relatively low degree of rigidity, kraft paper maybe used for the core, and combined with a plastic film and metal layer. Such a laminate might be produced on standard paper processing machinery, of the type commonly used in the packaging industry. As an alternative to polyethylene, polypropylene, polyester or polyimide plastics may be used and, rather than using a separate metal foil, the metal may be incorporated as a metallised film on the plastic. Typical dual laminate structures then are:

foil/PE/kraft/PE||PE/kraft/PE/foil or aluminised polyester/kraft/PE||PE/kraft/aluminised polyester To avoid delamination of such paper laminates in humid conditions a sealing medium may be applied to the edges of the structure. For example, a polymeric sealant such as latex (styrene-butadiene, acrylonitrile-styrene-butadiene, or PVC) or cyanacrylate or polyester or epoxy or even solvent-based nitrocellulose.

It is found that ideally the laminate thickness should be such as to give an areal density of no more than substantially 540 grams per square meter for a paper type core or substantially 700 gsm for an extruded polypropylene core.

Figure 3A:
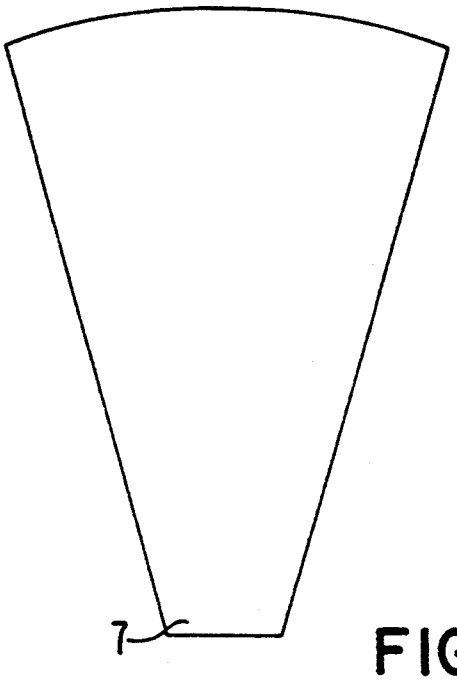
FIGS. 3A–3C are top and bottom views and a sectional view respectively of a reflector element.
Figure 3B:
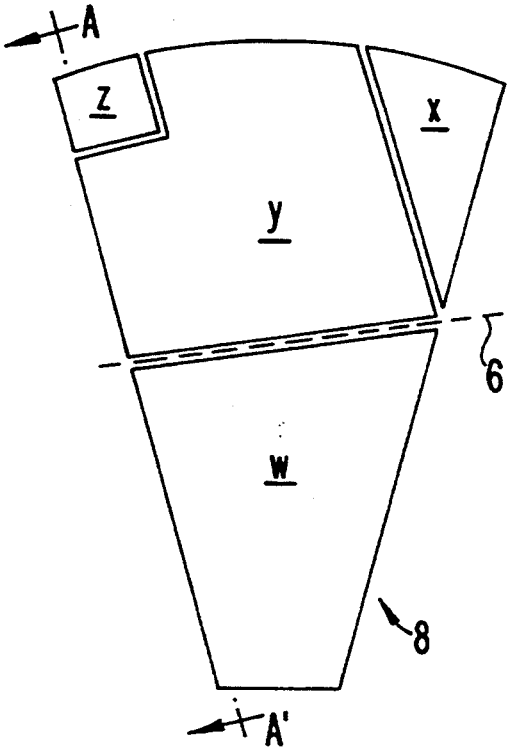
Figure 3C:
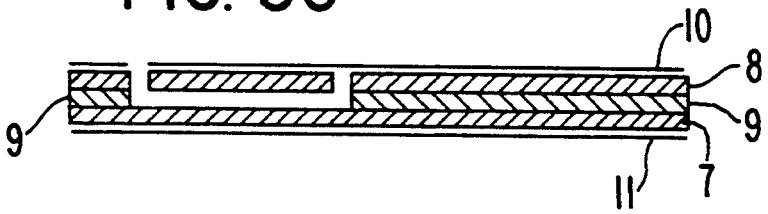
Figure 6:
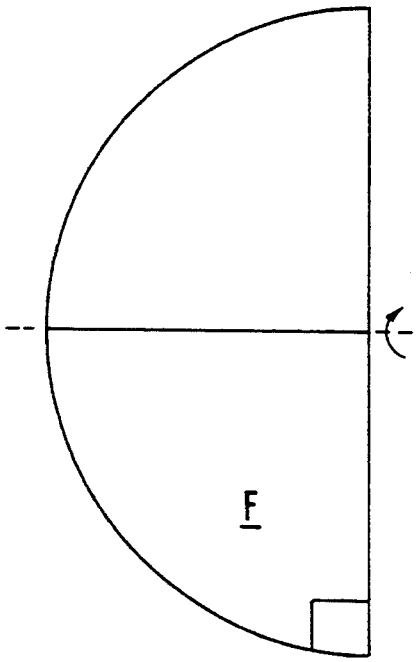
FIG. 6 is an plan of an end-element of the reflector of FIG. 2.

In forming a fold-flat structure of the type shown in FIG. 2 a separator plate is formed in one of the two layers making up the dual laminate structure of each trapezoidal element. The trapezoidal elements are arranged so that the separator plate is in the upwardly facing layer in one element and in the downwardly facing layer in the adjacent element and so on. The layer 7 in each element without a separator plate is cut from the laminate material as a single trapezoidal piece shown in FIG. 3A. As shown in FIG. 3B, the other layer 8 is assembled from elements comprising a truncated trapezoidal piece w, a substantially triangular corner piece x, the substantially square separator plate y, and a square corner piece z. The corner piece z remains in the plane of the laminate when the rest of the separator plate is folded up, to make contact with the adjacent reflector element when the reflector moves into its non-planar configuration. The pieces other than the separator plate are adhesively bonded to the upper surface of the lower layer of the dual laminate structure by an adhesive layer 9. In FIGS. 3B and 3C the separation between the pieces, and the thickness of the adhesive layer are exaggerated for clarity. The separator plate is left unbonded and is held in place by a jig during the lamination process. Then after the plastic film 10,11 has been laminated to the upper and lower surfaces of the dual laminate structure it is only necessary to cut that film along three sides of the separator plate to leave that plate with an effective hinge provided by the film extending from the truncated trapezoidal element across onto the plate. The plastics film extends across both the separator plate and the rest of the trapezoidal element and at the fourth edge where the plate meets the rest of the element provides the film hinge along the hinge line 6 indicated in FIG. 3B. The semi-circular end elements 12,13 both include generally quadrant shaped separator plates on their lower sides, as shown in FIG. 6.

In FIG. 2 hinge lines lying in the plane of the lowermost surface are indicated by L, and those lying in the plane of the uppermost surface by U. To configure the reflector for use, the separator plates are folded up about the film hinge to lie at an angle of substantially 90° to the plane of their respective trapezoidal elements. The trapezoidal elements are then folded in the directions indicated by the arrows in FIG. 2 until the edge of the separator plate normal to its hinge abuts the surface of the adjacent element.

The separator plates in conjunction with the adjacent elements then form a string of trihedral reflectors, generally similar to that shown in FIG. 1.

Figure 5:
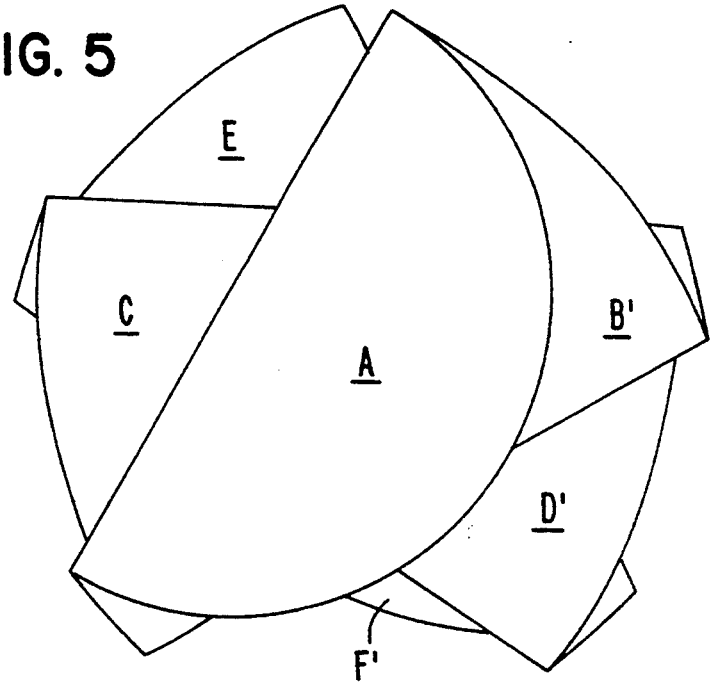
FIG. 5 is a plan of the reflector of FIG. 2 when collapsed.

To collapse the structure the separator plates are folded back into the planes of their respective trapezoidal elements and the trapezoidal elements folded towards each other until surface B lies on Sop of surface C, and surface C′ i.e. the underside of C, lies on top of D′, and so on FIG. 5 is a plan view of the reflector in the resulting collapsed configuration.

As an alternative to the arrangement shown in FIG. 2, the separator plates on the rear laminate may be doubled, that is formed in the-same elements which have separator plates in the front laminate. With this arrangement the rear separator plates would be formed in elements C′, E′. This configuration is more complex to multilaminate to make it fold flat in concertina fashion, and is therefore more suitable for designs which are collapsed by "stretching".

A number of alternative approaches are possible for moving the reflector from its collapsed state to its functional non-planar configuration. The structure may be deployed using strings. One string is attached to each separator plate and led through a hole in the spine at the point where the separator plate comes to rest at right angles when erected. If all the separator plates on the front flap upwards and those on the back flap downwards, then the strings on the up flaps, are led upwards while those on the back are led down. The strings may be lead individually to a top plate at one end of the reflector and to a similar bottom plate or may be routed through the spine and joined to a single string. In either case, the structure is deployed into its non-planar configuration by tensioning the strings.

An alternative and preferred approach to configuring the reflector uses self-tensioning members such as rubber bands or springs to achieve erection. Preferably EPDM rubber is used, as this material has a longer lifetime and is resistant to ozone attack. Within this general overall approach there are a number of different possible arrangements as set out below.

a - Hole Type, Centre Banding

In this method rubber bands are routed through the faces of the trapezium at the points where the separator plates on the front cross those on the back. A hole in this position centrally and correctly locates the separator plates on opposite faces of the trapezium and at the same time tensions the structure in its erected form. The tensioning band may be formed as a loop passing over the separator plate on both sides, through the hole and hooked over a double slot at the edge of the given trapezium, or the separator plate at its back when erected. Table (a) below is a routing chart for the structure shown in FIGS. 9A and 9B. In this example the front faces of the double laminate structures are designated by A–F respectively, and the corresponding rear faces by G–L. AS is the separator (S) plate in face A, CS the separator plate in face C and so on. In those cases where the other end of a band is not secured to a separator plate it may be located at any position on the named surface as long as it is clear of the moving plates. In practice it is often found best to fix the end on the short edge of the trapezium.

TABLE (a)

| Separator Plate attached to | Through | To |
|---|---|---|
| AS | B | IS |
| CS | D | KS |
| ES | F | F |

b - Hole Type, Separate Banding

As in the example discussed above, this method also uses centrally positioned holes to locate the position of the erected separator plates but each separator plate has its own band for erection typically secured to the short side of the trapezium plate through which it passes. This method is suitable both for configurations in which the separator plates are doubled—e.g. with plates in places ACEIK, or in structures where the separator plates on the front and rear are spaced, e.g. ACEHJ. Tables (b), (c) below show the routes used for the bands for these different respective configurations.

c - Stop Type

This third method combines the use of high modulus elastic cords threaded through the members in much the same way as the strings discussed above with low modulus cords. The high modulus cords act between adjacent reflector elements to draw the elements together to form the steps of the helix and the low modulus cords swing out the separator plates, with the high modulus cords acting as stops for the separator plates. Holes for the high modulus cords are formed in the spine ("top" and "bottom") at positions to locate the separator plate at right angles. Holes for the separator plates are formed near the face of the step being traversed to the short trapezium side. The length and tension of each cord is adjusted to give the required configuration. No cords pass centrally through the step faces but they may pass through the edge of the face.

TABLE (b)

| ACEIK | | |
|---|---|---|
| Separator Plate attached to | Through | To |
| AS | B | B |
| CS | D | D |
| ES | F | F |
| IS | H | H(B) |
| KS | J | J(D) |

TABLE (c)

| ACEHJ | | |
|---|---|---|
| Separator Plate attached to | Through | To |
| AS | B | B |
| CS | D | D |
| ES | F | F |
| HS | I | I(C) |
| JS | K | K(E) |

TABLE 1

| | | |
|---|---|---|
| a | polyester | 0.125 mm |
| b | polyester adhesive | |
| c | copper | 0.03 mm |
| d | polyester core | 2 mm |
| e | copper | 0.03 mm |
| f | polyester adhesive | |
| g | polyester | 0.125 mm |
| h | polyester adhesive [repeat a–g] | |

TABLE 2

| | | |
|---|---|---|
| a | polyimide | 0.5 mm |
| b | polyimide adhesive | |
| c | aluminium | 2.0 mm |
| d | aluminium honeycomb | 10 mm |
| e | aluminium | 2.0 mm |
| f | polyimide adhesive | |
| g | polyimide | 0.5 mm |
| h | polyimide adhesive [repeat a–g] | |

I claim:

1. A radar reflector comprising a plurality of rigid reflector elements, each element having at least a confronting surface reflective of radar radiation, said reflector having (a) an erected configuration in which the confronting surfaces of each adjacent pair of said reflector elements extend orthogonally, and (b) a collapsed configuration in which the confronting surfaces of each adjacent pair of said reflector elements lie in coplanar contiguous relationships;

a thin flexible member connecting adjacent ones of each adjacent pair or said reflector elements, said thin flexible member serving as a hinge permitting movement of said confronting surfaces between their orthogonal and contiguous coplanar relationships, said thin flexible member forming an integral part of at least one of said adjacent pairs of said reflector elements and extending coplanar with said confronting surface of said at least one of said adjacent pairs of said reflector elements.

2. A radar reflector according to claim 1, in which said reflector elements are formed as laminates, each said laminate including a rigid layer and a second layer providing said thin flexible member, said second layer extending integrally across each adjacent pair of said reflector elements.

3. A radar reflector according to claim 2, in which said thin flexible layer is a polymeric plastics film.

4. A radar reflector according to claim 3, in which said polymeric plastics film is selected from a polyester and a polyimide film.

5. A radar reflector according to claim 3, in which said polymeric plastics film is adhesively bonded to that surface of said rigid layer which provides the confronting surface of said reflector elements.

6. A radar reflector according to claim 3, in which the thickness of said polymeric plastics material lies in the range from 0.1 to 1.0 mm.

7. A radar reflector according to claim 6, in which the thickness of said polymeric plastics material lies in the range from 0.2 to 0.5 mm.

8. A radar reflector according to claim 1, in which said reflector elements include a core formed from twin-wall fluted polypropylene.

9. A radar reflector according to claim 8, in which said thin flexible member which serves as a hinge is formed by a crushed portion of said core along a hinge line.

10. A radar reflector according to claim 8, in which said core has a conductive ink printed on at least one surface to provide radar reflectivity.

11. A radar reflector according to claim 1, in which each said reflector element comprises a printed circuit board laminate including a metal layer on at least said confronting surface.

12. A radar reflector according to claim 8, in which the thickness of said metal layer lies in the range from 0.01 to 1.0 mm.

13. A radar reflector according to claim 1, in which each of said reflector elements includes a honeycomb cored metal faced structure.

14. A radar reflector according to claim 1, in which each reflector element is formed as a dual laminate structure comprising a pair of reflector elements according to claim 2 and each including its own rigid core, said reflector elements being bonded together on opposing surfaces.

15. A radar reflector according to claim 14, including a separator plate, said separator plate being formed as part of one reflector element of said pair of reflector elements forming said laminate structure, said separator element being arranged, in use, for movement out of a plane including said dual laminate structure, about a separator hinge formed by said thin flexible member so as to extend orthogonally to and between said confronting surfaces of said adjacent reflector elements when said elements are arranged in the erected configuration of said reflector.

16. A radar reflector according to claim 1, in which said reflector elements are formed by injection moulding and said thin flexible member is moulded integrally with said at least one of said adjacent pair of said reflector elements.

* * * * *